US006129211A

United States Patent [19]

Prakken et al.

[11] Patent Number: 6,129,211

[45] Date of Patent: Oct. 10, 2000

[54] RECTANGULAR SHIPPING BOX AND DISPLAY CONTAINER

[76] Inventors: Bouwe Prakken, P.O. Box 347, Woerden 3440AH, Netherlands; Martin Prakken, 16037 Innovation Dr., Colonial Heights, Va. 23834

[21] Appl. No.: 08/969,621

[22] Filed: Nov. 7, 1997

[30] Foreign Application Priority Data

Jan. 17, 1997 [NL] Netherlands ..... 1005038

[51] Int. Cl.[7] ..... B65N 1/22; B65N 25/04

[52] U.S. Cl. ..... 206/750; 206/526; 229/120.09

[58] Field of Search ..... 206/745–750, 206/526, 44 R; 229/120.11, 120.18, 120.09

[56] References Cited

U.S. PATENT DOCUMENTS

| | | | |
|---|---|---|---|
| 1,657,942 | 1/1928 | Spaldo | 229/120.09 X |
| 1,663,765 | 3/1928 | Lambert | 206/750 |
| 1,919,880 | 7/1933 | Einson . | |
| 2,020,876 | 11/1935 | Clark et al. . | |
| 2,131,391 | 9/1938 | Schraffenberger . | |
| 2,152,079 | 3/1939 | Mott . | |
| 2,269,715 | 1/1942 | Fischer . | |
| 2,315,999 | 4/1943 | Holm . | |
| 2,336,088 | 12/1943 | Goodyear et al. . | |

(List continued on next page.)

FOREIGN PATENT DOCUMENTS

| | | |
|---|---|---|
| 0 726 205 | 8/1996 | European Pat. Off. . |
| 2 663 614 | 12/1991 | France . |
| 2 669 893 | 6/1992 | France . |
| 296 11 809 | 1/1997 | Germany . |
| 302 307 | 10/1965 | Netherlands . |
| 7 205 624 | 10/1973 | Netherlands . |
| 358560 | 11/1931 | United Kingdom . |
| 1 454 527 | 11/1976 | United Kingdom . |
| 91/15403 | 10/1991 | WIPO . |

OTHER PUBLICATIONS

Advertising material relating to the PROFILE SAAM Box.

*Primary Examiner*—Bryon P. Gehman

*Attorney, Agent, or Firm*—Jacobson, Price, Holman & Stern, PLLC

[57] ABSTRACT

A rectangular folding box comprises at least four side walls (1 to 4 inclusive), which are connected to one another by fold lines, and a bottom wall (5 to 8 inclusive) comprising flaps. In order to provide the folding box with a display function, one of the side walls (1) has in the center a tear line (14) which runs perpendicular to the bottom wall (5 to 8 inclusive). Furthermore, the bottom wall has in the center a tear line (16, 17) which adjoins the tear line (14) of the said side wall (1). The side wall (3) which is situated opposite the side wall (1) provided with a tear line (14) can be folded along a line (15) which adjoins the tear line (16, 17) of the bottom wall and runs parallel to the tear line (14) of the first side wall (1) mentioned. The folding box is formed from a one-piece, substantially rectangular foldable blank of corrugated cardboard provided with a unique arrangement of fold lines, tear lines, tear strips and cut lines or severance lines to facilitate formation of the shipping box and conversion to a display container. In one embodiment, the top or front wall has a removable panel connected to a tear tape which facilitates the box being divided into two container sections. The sections are then pivoted to a position alongside of each other to expose a plurality of packages oriented interiorly of the container in a manner to effectively display the packages.

29 Claims, 10 Drawing Sheets

U.S. PATENT DOCUMENTS

| | | | |
|---|---|---|---|
| 2,395,558 | 2/1946 | Lighter . | |
| 2,407,415 | 9/1946 | Graziano . | |
| 2,446,366 | 8/1948 | Epps . | |
| 2,751,964 | 6/1956 | Guyer . | |
| 2,888,132 | 5/1959 | Guyer . | |
| 2,967,610 | 1/1961 | Ebert et al. . | |
| 3,002,613 | 10/1961 | Merkel et al. | 229/120.09 X |
| 3,050,234 | 8/1962 | Salmon . | |
| 3,090,483 | 5/1963 | Altree et al. . | |
| 3,139,979 | 7/1964 | Russel | 229/120.09 X |
| 3,263,900 | 8/1966 | Link et al. | 229/120.09 |
| 3,280,968 | 10/1966 | Craine . | |
| 3,305,078 | 2/1967 | Ferrera . | |
| 3,322,263 | 5/1967 | Gulliver . | |
| 3,326,369 | 6/1967 | Tolaas et al. . | |
| 3,360,120 | 12/1967 | Getzin | 206/526 X |
| 3,362,616 | 1/1968 | Van Dyck . | |
| 3,385,430 | 5/1968 | Benzon-Petersen . | |
| 3,389,850 | 6/1968 | Rockefeller . | |
| 3,458,109 | 7/1969 | Compton et al. . | |
| 3,474,949 | 10/1969 | Shine | 229/120.09 |
| 3,653,495 | 4/1972 | Gray . | |
| 3,884,348 | 5/1975 | Ross . | |
| 4,039,120 | 8/1977 | Herzog . | |
| 4,053,101 | 10/1977 | Hart, Jr. . | |
| 4,077,512 | 3/1978 | Heaton . | |
| 4,113,100 | 9/1978 | Soja et al. . | |
| 4,377,237 | 3/1983 | Pawlowski . | |
| 4,467,923 | 8/1984 | Dornbusch et al. . | |
| 4,519,538 | 5/1985 | Omichi . | |
| 4,553,666 | 11/1985 | Gullikson . | |
| 4,742,917 | 5/1988 | Bornwasser et al. . | |
| 4,746,010 | 5/1988 | Fournier . | |
| 4,773,541 | 9/1988 | Riddell . | |
| 4,778,057 | 10/1988 | Allen et al. . | |
| 4,793,487 | 12/1988 | Bentsen et al. . | |
| 4,905,837 | 3/1990 | Schuster et al. . | |
| 4,919,269 | 4/1990 | Wright et al. . | |
| 5,012,929 | 5/1991 | Roosa . | |
| 5,034,234 | 7/1991 | Andreas et al. . | |
| 5,050,741 | 9/1991 | Kim . | |
| 5,092,467 | 3/1992 | Elward . | |
| 5,098,757 | 3/1992 | Steel . | |
| 5,167,324 | 12/1992 | Miller . | |
| 5,249,738 | 10/1993 | Werth . | |
| 5,299,733 | 4/1994 | Werth . | |
| 5,318,223 | 6/1994 | Gale . | |
| 5,332,150 | 7/1994 | Poirier . | |
| 5,398,869 | 3/1995 | Dickson et al. . | |
| 5,413,276 | 5/1995 | Sheffer . | |
| 5,415,343 | 5/1995 | Vosbikian . | |
| 5,465,151 | 11/1995 | Parker et al. . | |
| 5,505,371 | 4/1996 | O'Neill . | |
| 5,507,430 | 4/1996 | Imhoff . | |
| 5,507,432 | 4/1996 | Cyr . | |
| 5,555,982 | 9/1996 | Kuhn et al. . | |
| 5,560,692 | 10/1996 | Smith . | |
| 5,572,825 | 11/1996 | Gehret . | |
| 5,582,345 | 12/1996 | Lankhuijzen . | |
| 5,660,325 | 8/1997 | Zacher . | |

RECTANGULAR SHIPPING BOX AND DISPLAY CONTAINER

BACKGROUND OF THE INVENTION

1. Field of the Invention

The present invention relates to a rectangular folding box, at least comprising: four side walls, which are connected to one another by fold lines, and a bottom wall comprising at least one flap. More specifically, the present invention relates to a corrugated box for shipping which can be easily converted to a container for displaying articles, especially packages in the form of flexible tapered pouches which are flat on one end. The shipping and display container of this invention is formed from a one-piece generally rectangular foldable blank of planar construction provided with a unique arrangement of fold lines, tear lines and cut lines or severance lines. These lines facilitate the box being set up for receiving a plurality of articles and shipped to a destination and then opened along defined die cut lines to facilitate the box being divided into two sections. The two section are connected along a fold line extending from the front-to-rear of the box with the two sections of the box then being pivoted to a position alongside of each other to expose the plurality of packages oriented interiorly of the box in a manner to effectively display the packages.

2. Description of the Prior Art

Various articles including food articles are frequently packaged in flexible pouches or packages which are difficult to display. Such food articles include snack items, animal feed packages and the like and typically are supported on various types of display racks which support the articles in a manner so that a customer can easily observe and gain access to the packages. It has been the practice to package the flexible pouches or packages in a corrugated board box or container which is shipped to a point of distribution such as a retail site at which point the box or container is opened and the flexible pouches or packages are removed and placed on the display rack.

Folding boxes of this kind are generally known and are often given the name American folding box or regular slotted container (RSC). These boxes have cover flaps which in the closed position completely cover the top of the box. The folding boxes are produced from a cardboard blank, adhesive bonding (hot melt or cold melt) being used. Advantages of such a box are the low price and the possibility of stacking filled bags with a tapering opening end in a staggered manner on top of one another, thus allowing them to be accommodated without loss of volume. A drawback is that when the cover flaps are folded open the presentation of the bags in the horizontal position is extremely poor. Although a better presentation of the bags with tapering opening ends could be achieved by placing the bags upright in the box, this would be at the expense of a high loss of volume in the box.

The object of the invention is to avoid the above drawbacks and to provide a relatively inexpensive (American) folding box which is modified such that bags with tapering opening ends can be accommodated in the box in a staggered, mutually overlapping manner without loss of volume while nevertheless allowing an attractive presentation of the bags.

Several U.S. patents illustrate box structures in which the articles such as flexible pouches are shipped, can be converted at the site of sale or use to a display container. Such patents include:

| | | |
|---|---|---|
| 1,919,880 | 2,446,366 | 3,305,078 |
| 2,020,876 | 2,888,132 | 3,362,616 |
| 2,131,391 | 3,139,979 | 3,385,430 |
| 2,152,079 | 3,280,968 | 3,653,495 |
| 2,269,715 | | |

Specifically, U.S. Pat. No. 3,653,495 discloses a container which can be shipped with a plurality of overlapping pouches therein and converted to a display device at a retail site. The structure in this patent involves various features, however, such as internal partitions and edgewise loading of the pouches, that complicate the setup and loading of the box.

While the above patents disclose shipping boxes which can be converted to a display device, the prior patents do not disclose the specific unique structural features of this invention which enable it to be effectively used in automatic case loading and sealing operations, shipped to a destination while oriented on a pallet or other similar structure in a manner to provide stable support and strength to minimize the possibility of crushing or damage to the box and contained articles and with the major dimensions oriented horizontally to position the boxes in a stable condition on a pallet or the like and which can be easily and quickly converted to a display container when it arrives at the retail outlet or other destination.

SUMMARY OF THE INVENTION

The shipping box and display container of this invention is constructed from a single piece of double faced corrugated cardboard. The one-piece blank preferably has a generally rectangular configuration so as to avoid unnecessary waste of the corrugated cardboard material. The one piece blank has edge fold lines to form two pair of opposed generally parallel and lo rectangular side walls. One pair of side walls is typically larger than the other pair and are referred to as a upper side wall and a lower side wall interconnected by the other pair of side walls, referred to as the end side walls. The side walls are interconnected to form the rectangular box shape preferably by a folded fastening flap, such as along the outer edge of an end side wall which is adhesively secured to the inside edge of the lower side wall. Extending laterally from each edge of the four side walls and interconnected by appropriate fold lines are flaps which overlap and seal to form the bottom or rear wall of the box and the top or front wall of the box.

According to the present invention, the folded box is characterized in that one of the side walls (the upper side wall) has in the center a tear line which runs perpendicular to the bottom wall, in that the bottom wall in the center has a tear line which adjoins the tear line of the said upper side wall, and that the side wall (the lower side wall) which is situated opposite the side wall provided with a tear or fold line can be folded along a line which adjoins the tear line of the bottom wall and runs parallel to the tear line of the first (upper) side wall mentioned.

In order to convert the box into the presentation condition, after transportation, for upright display of the contained pouches or packages, the upper side wall and bottom wall which are provided with a tear line are divided in two along the said tear lines. The lower side wall, which is situated opposite the upper side wall provided with the tear line, is then folded double, and the box is tipped over in such a manner that the bottom wall comes to stand upright. To facilitate the tearing and dividing of the upper side wall and bottom wall, the tear line can include a tear tape adhered along the inside surface.

In one embodiment, the top edges of the side walls are connected, via fold lines, to top flaps, the width of which is so small that in the position in which they are folded parallel to the bottom wall they cover only part of the top of the box. The top flaps which adjoin the upper side wall which is provided with the tear line and the lower side wall which is situated opposite this side wall, respectively, will each be provided in the center with an incision or tear line. In order to seal the top of the box in the transportation position in this embodiment, an inlay board may be placed on the stacked bags.

By dividing the box in two and folding it in the above-mentioned way and tipping the said box through 90°, a double display is formed. The invention furthermore relates to a cardboard blank from which the folding box according to the invention with display features can be folded.

In another embodiment of the present invention, the top wall flaps on the upper side wall and lower side wall, which form the top or front wall of the shipping box, preferably both have a removable segment or panel which is separated from the top wall flaps when converting the box from a shipping box to a display container. The separation of the removable segments or panels from the top wall flaps open the top of the box and then facilitate dividing the upper side wall and bottom wall into the double display containers along the center tear lines. If the tear line includes a tear tape along the inside surface of the walls, the tear tape is preferably continued onto the removable panel of the top wall upper flap so that removal and separation of this removable panel allows the user to continue the tearing operation with the tear tape along the tear line in one continuous operation.

In this embodiment, the lower side wall is also provided with a centrally disposed fold line so that the two halves of the lower side wall can fold into abutting relation to provide two side-by-side display container sections or receptacles with the articles disposed vertically, facing front, in each of the receptacles for observation and access on a retail shelf or the like.

The present invention is especially useful for shipping and displaying flexible pouches or packages having a flat panel at the bottom which allows the pouch or package to stand upright on a shelf or the like. The top of the pouch or package, on the other hand, has the sides sealed together so that the package is very thin at the top, while thick at the bottom due to the bottom panel. The present invention allows the pouches or packages to be packed for shipping with the tops in overlying relation to reduce the volume of the box. The box can then be divided and rotated 90° so that the pouches or packages are displayed in an open upright condition on the store shelf or the like. The invention is also especially useful for flexible pouches or packages which have a length dimension greater than the width dimension so as to take better advantage of the overlapping nature of the package tops in the shipping box.

Accordingly, it is an object of the present invention to provide a shipping box convertible to a display container in which a plurality of articles in the form of flexible pouches or packages, especially pouches or packages having a flat bottom for standing upright, are positioned horizontally in the box with the top ends thereof partially overlapping in the box center to occupy the complete interior of the box, with the container being convertible to a display unit by separating the top wall, one side wall and the rear wall of the box into two container sections and then pivoting the sections about a center line in the opposed side wall into abutting side-by-side relation thus orienting the packages or pouches in a vertical, facing front, accessible position.

Another object of this invention is to provide a shipping box or container in accordance with the preceding object constructed from a single, generally rectangular blank to enable most efficient use of the material from which the blank is formed, with the container preferably being constructed from double faced corrugated cardboard.

A further object of this invention is to provide a shipping box or container in accordance with the preceding objects in which the top and interior of the container are completely open when being loaded so that the packages or pouches can be inserted therein through the open top of the box, with the box top then being sealed in a conventional manner.

Yet another object of this invention is to provide a shipping box or container in accordance with the preceding objects in which the top and interior of the container when being loaded are completely open so that the packages or articles can be inserted therein in two vertical stacks, thus when the box is standing upright the articles are horizontally oriented and the top thin ends of the packages overlap in the center of the box.

Still another object of this invention is to provide a box in accordance with the preceding objects in which the top wall flaps include a die cut separable portion which is removed when the shipping box is converted to a display container and the upper side wall and upper side wall flaps forming a portion of the bottom wall and top wall have a continuous tear tape secured to the inner surface along a tear line extending throughout the length thereof, which enables the upper side wall and the flaps to be easily separated from each other when the two side-by-side container sections are formed.

A still further object of the present invention is to provide a shipping box or container in accordance with the preceding objects in which the corrugations in the double faced corrugated cardboard are oriented in an optimum relation to the tear lines of the upper side wall and top and bottom walls to facilitate separation of the box along the tear lines with or without tear tape.

Yet a further object of this invention is to provide a shipping box or container in accordance with the preceding objects in which the top and bottom wall flaps are configured to provide maximum support and stacking stability for the box when in its shipping mode, typically when the upper and lower side walls are positioned horizontally.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
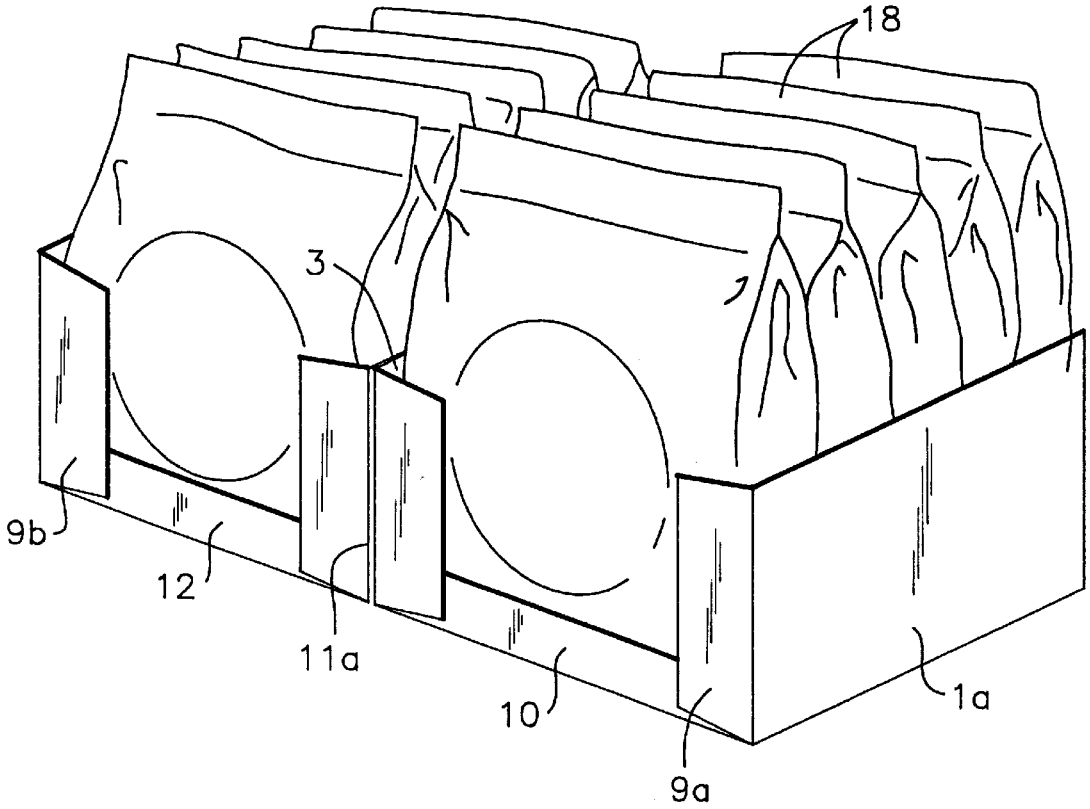
FIG. 1 shows a perspective view of a folding box according to a first embodiment of the invention in the display position.

In describing the preferred embodiments of the present invention as illustrated in the drawings, specific terminology will be resorted to for the sake of clarity. However, the invention is not intended to be limited to the specific embodiments illustrated and terms so selected; it being understood that each specific term includes all technical equivalents which operate in a similar manner to accomplish a similar purpose.

Figure 2:
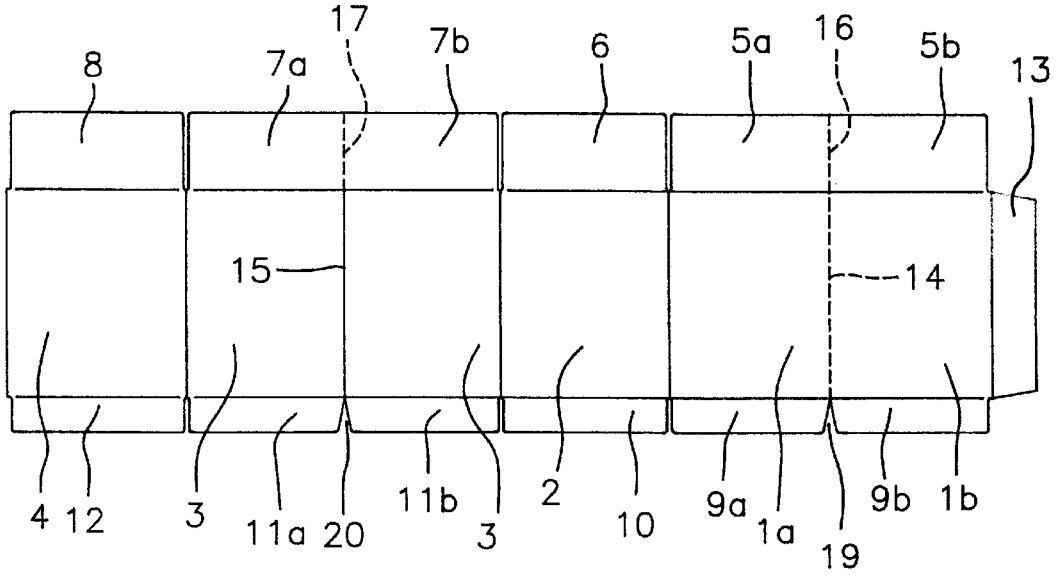
FIG. 2 shows a cardboard blank from which the folding box of FIG. 1 is produced.
Figure 3:
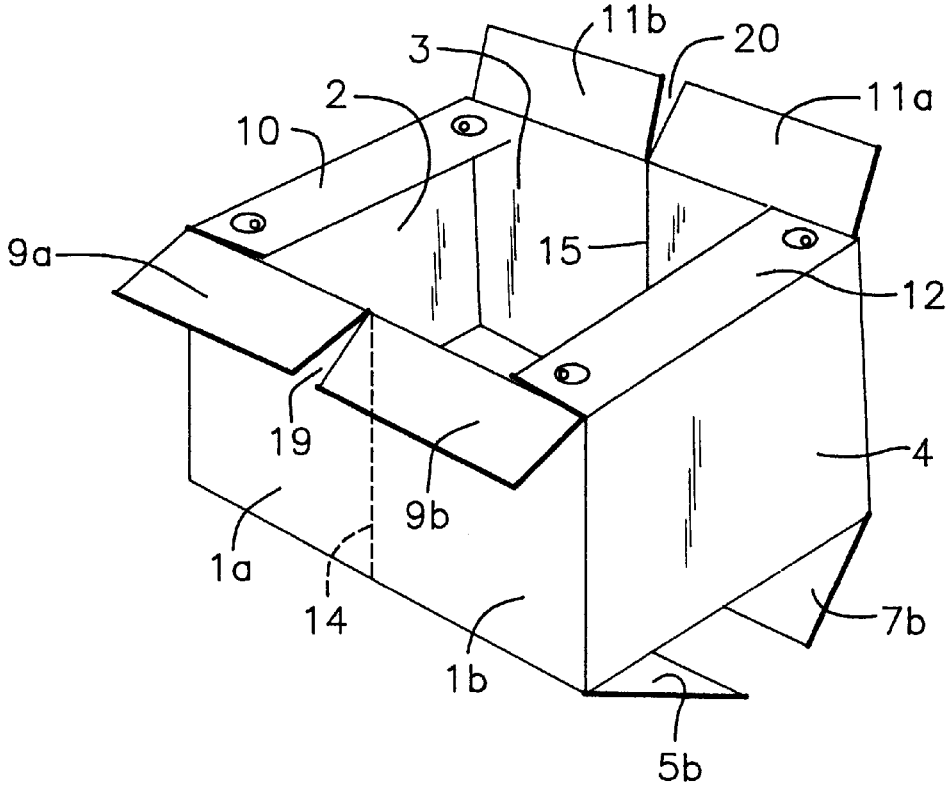
FIG. 3 shows a perspective view of the folding box of FIG. 1 in the transportation and storage position.

The display packaging shown in FIG. 1 is formed in a simple manner from a rectangular folding box depicted in FIG. 3 and having four side walls 1, 2, 3 and 4, a bottom comprising four flaps 5, 6, 7 and 8, and four top flaps 9, 10, 11 and 12. This box is in turn formed from the cardboard blank which can be seen in FIG. 2. The side wall 1 has a fastening flap 13 and is divided by a tear line 14 into two parts 1*a*, 1*b*. A score line 15 is made in the center of the side wall 3. The bottom flap 5 is divided into two parts 5*a*, 5*b* by a tear line 16 which adjoins tear line 14, and in a corresponding manner the bottom flap 7 is divided into two parts 7*a*, 7*b* by a tear line 17. The tear line 17 adjoins the score line 15.

In order to make a conventional folding box (American folding box) from the cardboard blank, the side wall 2 is folded through 90° with respect to the side wall 1*a, b*, the side wall 3 is folded through 90° with respect to the side wall 2, the side wall 4 is foled through 90° with respect to the side wall 3 and then the flap 12 is adhesively bonded to the inside of the flap 4. Meanwhile, the bottom flaps 5*a, b*, 6, 7*a, b* and 8, like the top flaps 9*a, b*, 10, 11*a, b* and 12, are folded inwards.

Figure 5:
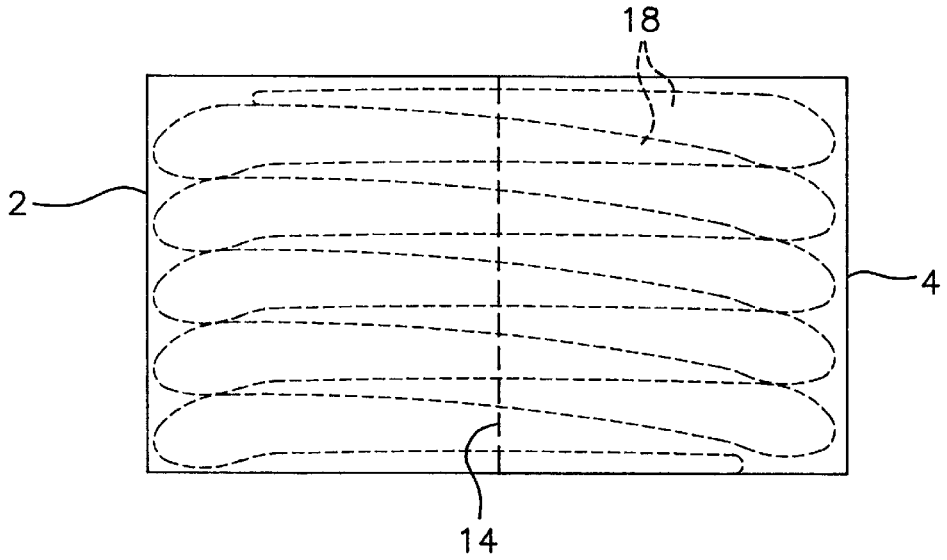
FIG. 5 shows a side elevational view of the folding box of FIG. 1 with the tapering filled bags shown in phantom lines.

It can be seen in FIG. 5 how a box is filled with tapering filled bags 18. The bags are stacked in a staggered manner on top of one another. In order to cover the bags during transportation or storage, an inlay board which is slightly smaller than the horizontal cross-section of the box can be placed on the bags, the tops flaps 10 to 12 inclusive being folded onto the said inlay board.

It will be clear that by removing the inlay board and folding open the top flaps the presentation of the bags 18 leaves much to be desired. The box of the present invention has means of overcoming this drawback.

Figure 4:
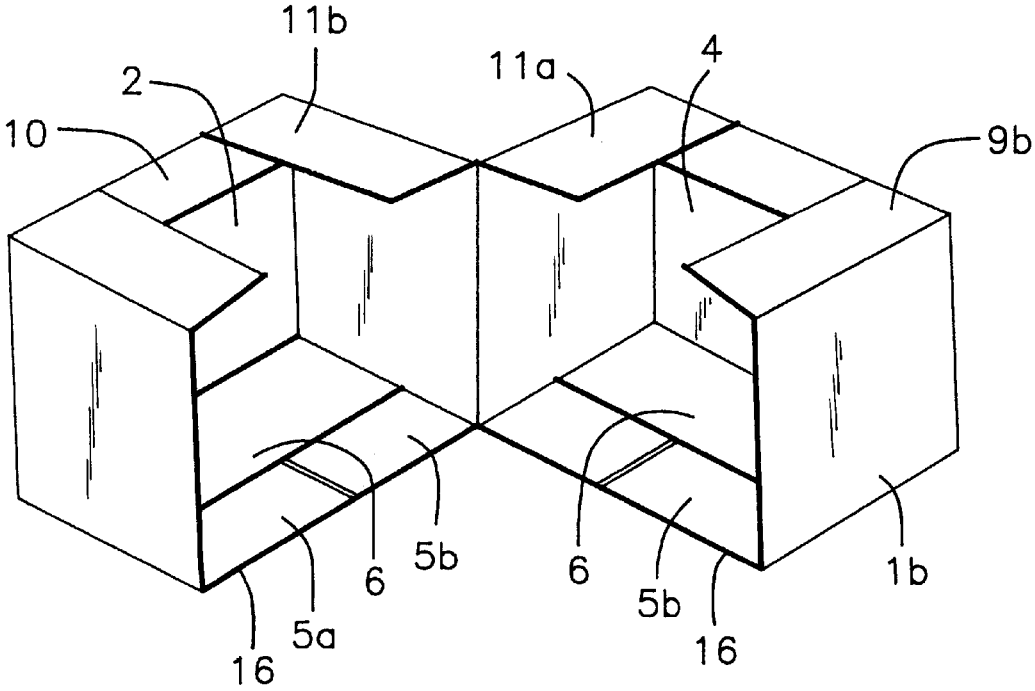
FIG. 4 shows a perspective view of the change from the transportation position of the folding box of FIG. 1 to its display position.

By tearing open the side wall 1*a, b* at tear line 14 and the bottom flaps 7*a, b* at tear line 16, folding open the halves thus obtained along the score line 16 in the manner shown in FIG. 4 until the bottom side face 3 is folded completely in two (in which position the faces of the two halves 3 bear against one another) and finally tipping over the box containing bags 18 through 90° such that the two side-face parts 3 form bottom parts, the display position as shown in FIG. 1 is produced.

The term tear line (see 14 and 16) should be interpreted broadly. A tear line will usually comprise a perforation. However, the situation where the box parts on either side of the lines 14, 16 are already separate from one another in the transport/storage situation shown in FIG. 3 and where the said box parts are joined together by adhesive tape or similar material is not ruled out, in which case, in order to change from the box shape in accordance with FIG. 3 to the box shape in accordance with FIG. 1 the adhesive tapes are removed. Zip-fasteners or the like are also possible instead of the tear lines 14, 16.

In the case of easily foldable material, under certain circumstances the score line 15 may be dispensed with.

An embodiment in which the top flaps 9*a*, 9*b*, 10, 11*a, b*, 12 are somewhat wider and completely cover the top opening in the closed position of the box also lies within the scope of the invention. In that case, the said top flaps will be provided with fold lines, in order to be able to tear off parts of them in the state in accordance with FIG. 1, as a result of which the state shown in FIG. 1 is produced. It will be clear that the flaps 9*a* and 9*b* and the flaps 11*a* and 11*b*, respectively, may be separated from one another by means of incisions 19 and 20, respectively, or it must be possible to tear or cut them apart. The bottom wall could comprise a flap which is connected to a side wall via a fold line and is detachably connected to one or more of the other side walls.

Turning now to the embodiment illustrated in FIGS. 6–12, the shipping box or container is generally designated by reference numeral 110 and is in the form of a parallelepiped container having a generally rectangular, horizontally disposed upper side wall 112 which is substantially parallel to a similar sized lower side wall 114. The upper and lower side walls 112 and 114 are interconnected by substantially parallel end side walls 116 and 118. The front or top wall of the box 110 is generally designated by reference numeral 120 and the rear or bottom wall of the box is generally designated by reference numeral 122.

Figure 12:
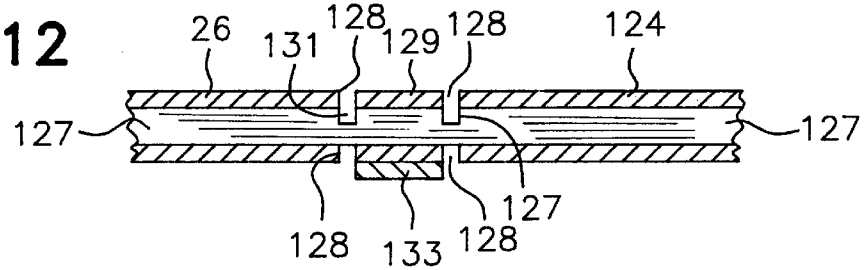
FIG. 12 is an enlarged sectional view taken along section line 12—12 on FIG. 6 illustrating details of the tear tape and intermittent perforated lines in the corrugated cardboard.

The upper side wall 112 includes a right hand wall segment 124 and a left hand wall segment 126 which are delineated by a transversely extending severance line generally designated by the numeral 125. The severance line 125, in this embodiment, is preferably in the form of a pair of spaced parallel weakened, intermittent perforated lines 128 through the corrugated cardboard which forms a tear strip 129 extending from the front to the rear of the upper side wall 112. The perforated lines 128 and tear strip 129 also extend along the center of the flap 153 which forms the upper half of the rear wall 122 (see FIG. 8). The corrugations 127 in the upper side wall 112 also have interrupted perforated lines 131 (see FIG. 12). A high strength tear tape 133 is preferably attached by adhesive, tape or the like to the inner surface of the upper side wall 112, front wall 120 and along the center of the upper flap 153 of rear wall 122 in order to enable removal of tear strip 129, as illustrated in FIGS. 6, 7 and 12.

Figure 6:
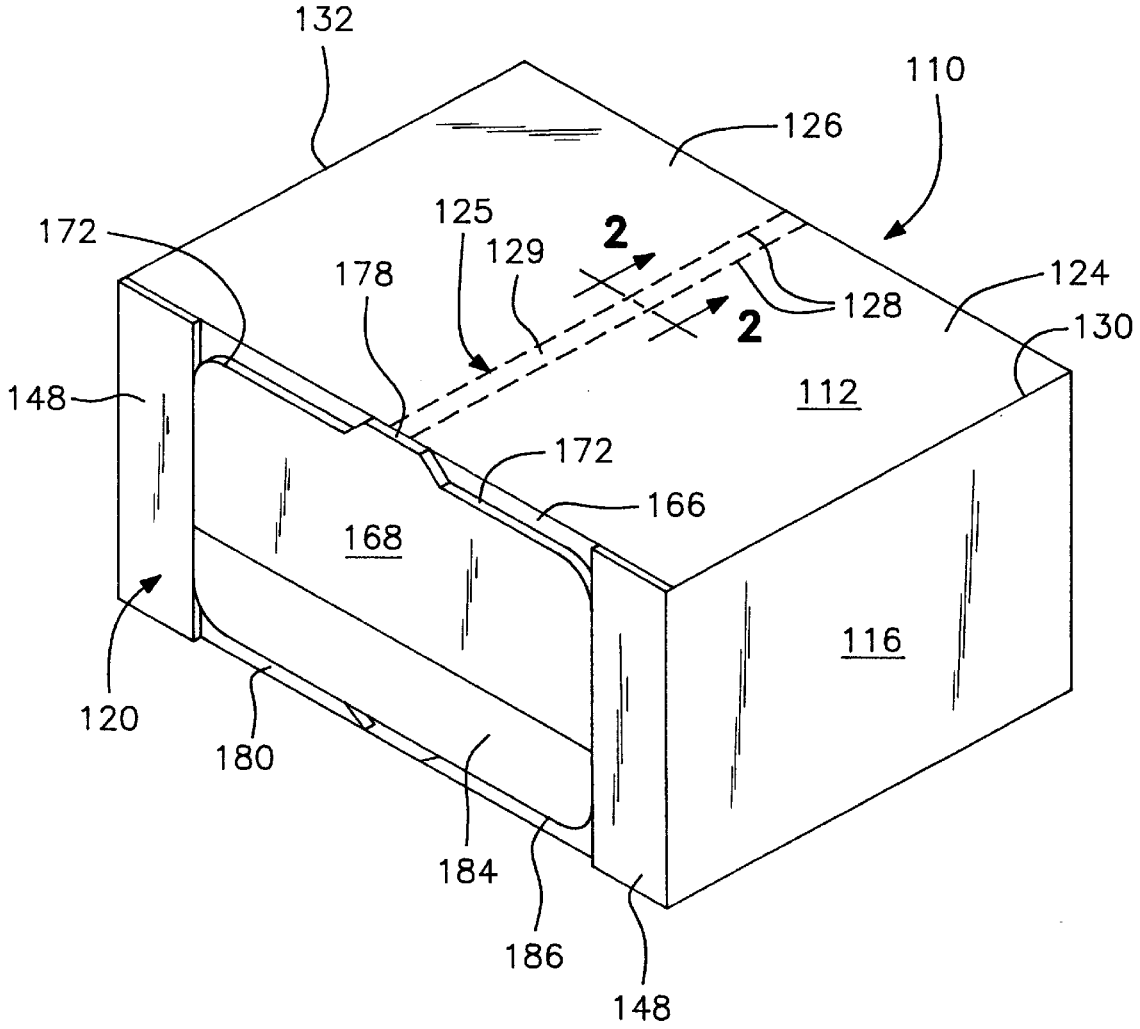
FIG. 6 is a front perspective view of a second embodiment of the shipping box and display container of the present invention in its shipping mode.
Figure 7:
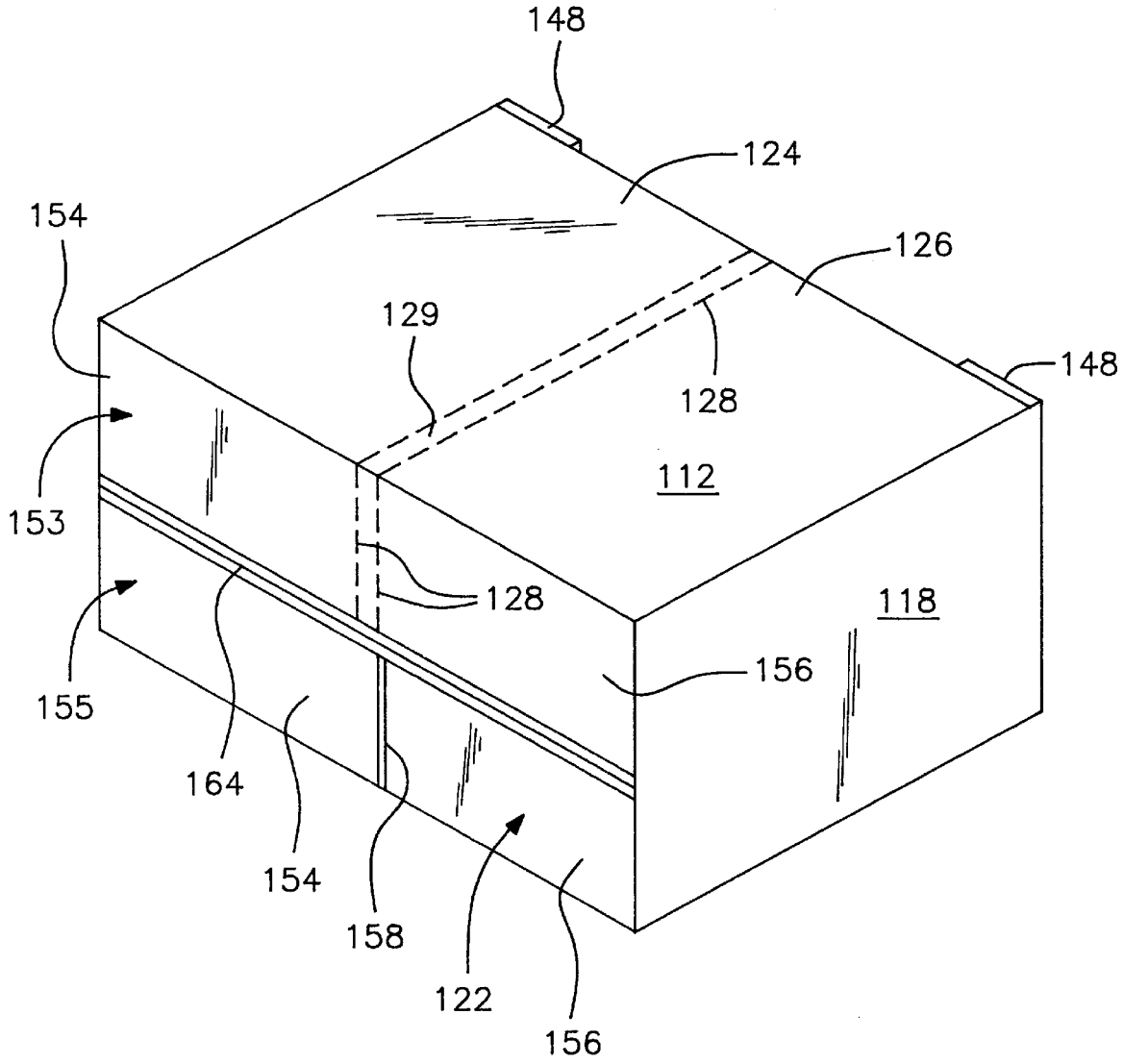
FIG. 7 is a rear perspective view of the box shown in FIG. 6.
Figure 11:
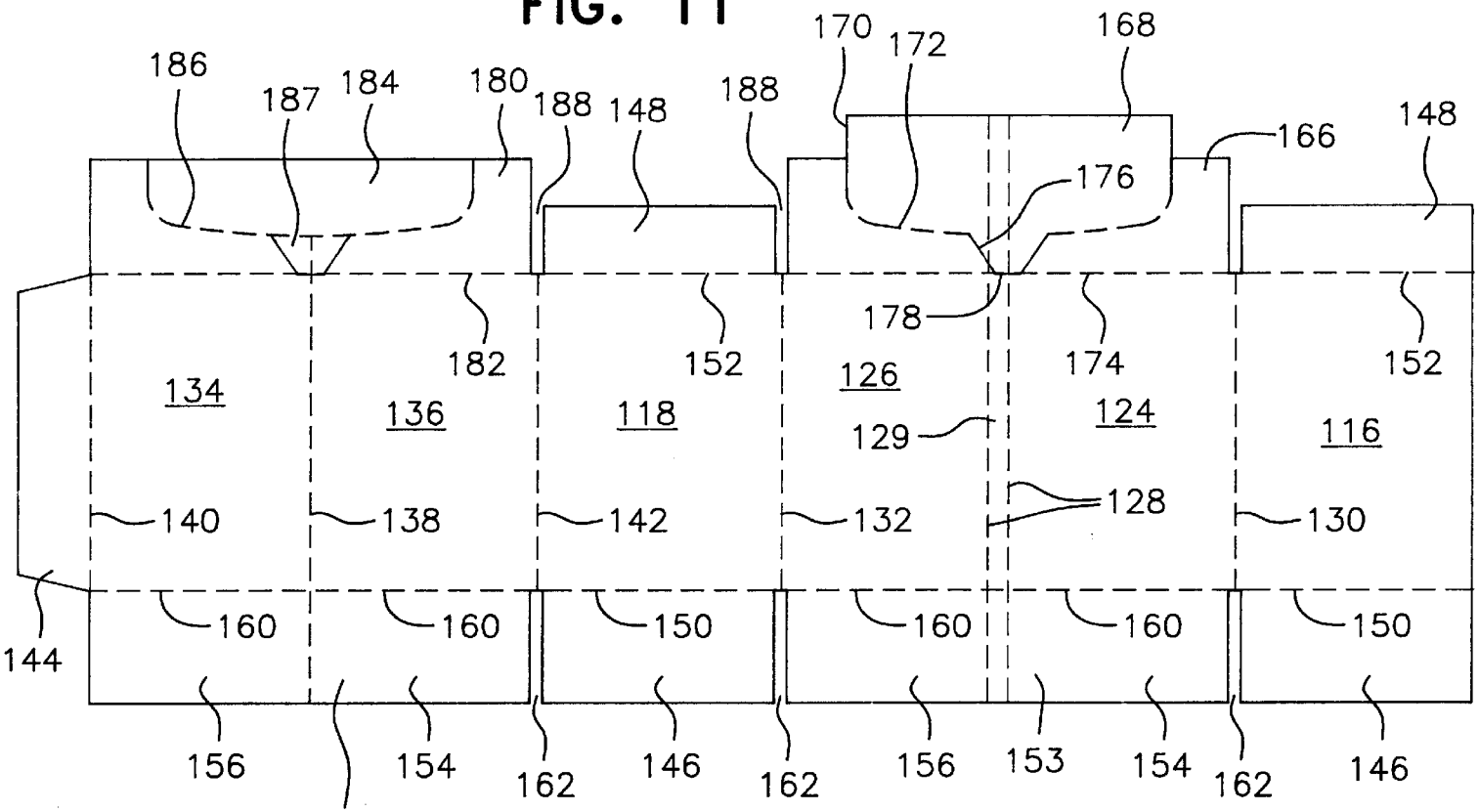
FIG. 11 is a plan view of the blank from which the box shown in FIGS. 6–11 is formed.

The outer edges of the upper side wall 112 are connected to the end side walls 116 and 118 by fold lines 130 and 132 as illustrated in FIGS. 6 and 11. The lower side wall 114 is divided into right hand wall segment 134 and left hand wall segment 136 by a centrally disposed fold line 138 which extends from the front-to-rear of the lower side wall 114 substantially along the center thereof. The panels segments 134 and 136 are provided with fold lines 140 and 142 at the outer edges thereof, and the fold line 140 is connected to a fastener flap 144. When the blank shown in FIG. 12 is folded 90° at each fold line 140, 142, 132 and 130 to assume the shape of the shipping box 110, the fastener flap 144 extends along the interior surface of end side wall 116. Fastener flap 114 is then securely fixed to the inside of wall 116 adjacent its outermost edge by suitable adhesive or the like, thus forming the sides of the box 110 having substantially parallel upper and lower side walls 112 and 114 and substantially parallel end side walls 116 and 118 interconnected permanently to the upper and lower side walls by fold lines.

Typically, upper and lower side walls 112 and 114 are larger than end walls 116 and 118 and, therefore, box 110 is preferably oriented with the upper and lower side walls 112 and 114 in a horizontal position and end side walls 116 and 118 in a vertical position for shipping. Thus, when a number of boxes 110 is stacked on a pallet or the like, the greater dimensions of the upper and lower side walls 112 and 114 provide greater lateral stability for the stacked boxes. Further, as described later herein, box 110, and the corrugations of the box material, are designed to provide the necessary strength and support for stacking the boxes 110 with walls 112 and 114 in a horizontal position.

The end side wall 116 includes a partial rear or bottom end flap 146 at one end and a partial front or top end flap 148 at the other end, with the flap 146 being connected to the panel 116 along fold line 150 and flap 148 being connected to panel 116 along fold line 152. The end side wall 118 is provided with corresponding flaps to those of wall 116. The upper and lower side walls 112 and 114 also each include a rear wall flap, rear upper flap 153 and rear lower flap 155. The rear upper flap 153 and rear lower flap 155 are each divided into a pair of rear wall sections 154 and 156. The rear wall sections 154 and 156 on rear lower flap 155 are separated from each other by a line of separation 158, such as by perforation or the like. All of the flaps are connected to their respective side walls by fold lines 160 so that when the blank is set up to form the rectangular container 110, the end flaps 146, 153 and 155 will overlap in a manner to form rear or bottom wall 122. Further, the rear wall sections 154 and 156 on the rear lower flap 155 can be separated from each other along separation line 158, and the rear wall sections 154 and 156 on the rear upper flap 153 can be separated from each other when opening the tear strip area 128 to convert the container from the shipping mode to the display mode.

Figure 8:
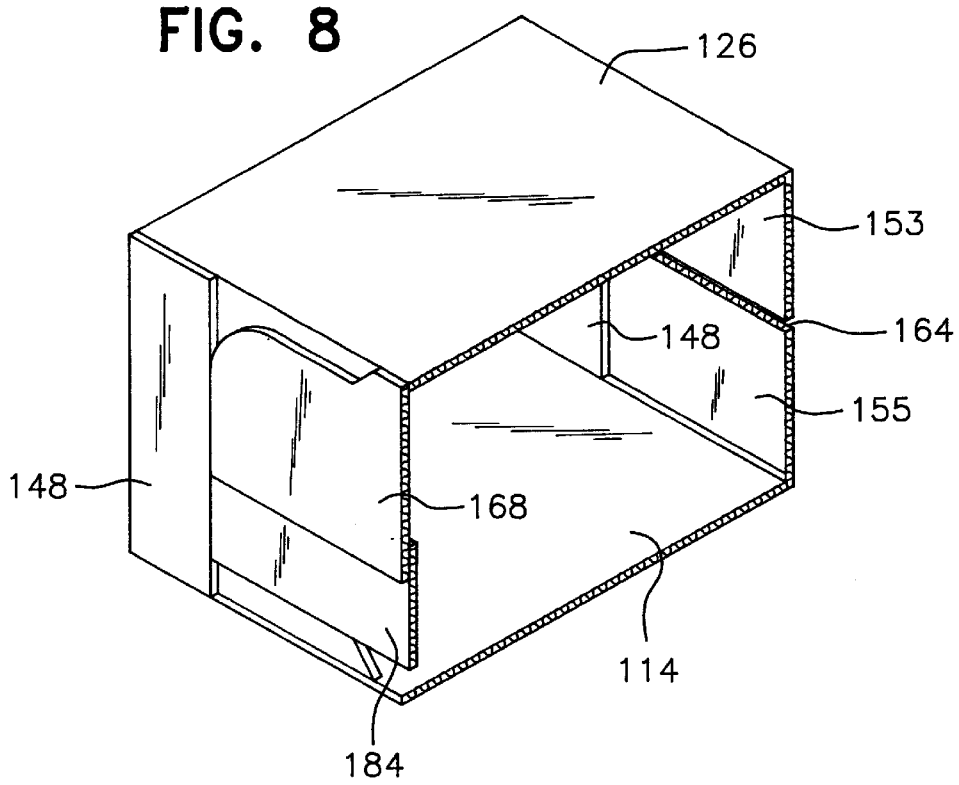
FIG. 8 is a transverse sectional view of the box of FIG. 6 taken generally along the center line of the upper and lower side walls and illustrating the relationship of the flaps when the container is in the shipping mode.
Figure 9:
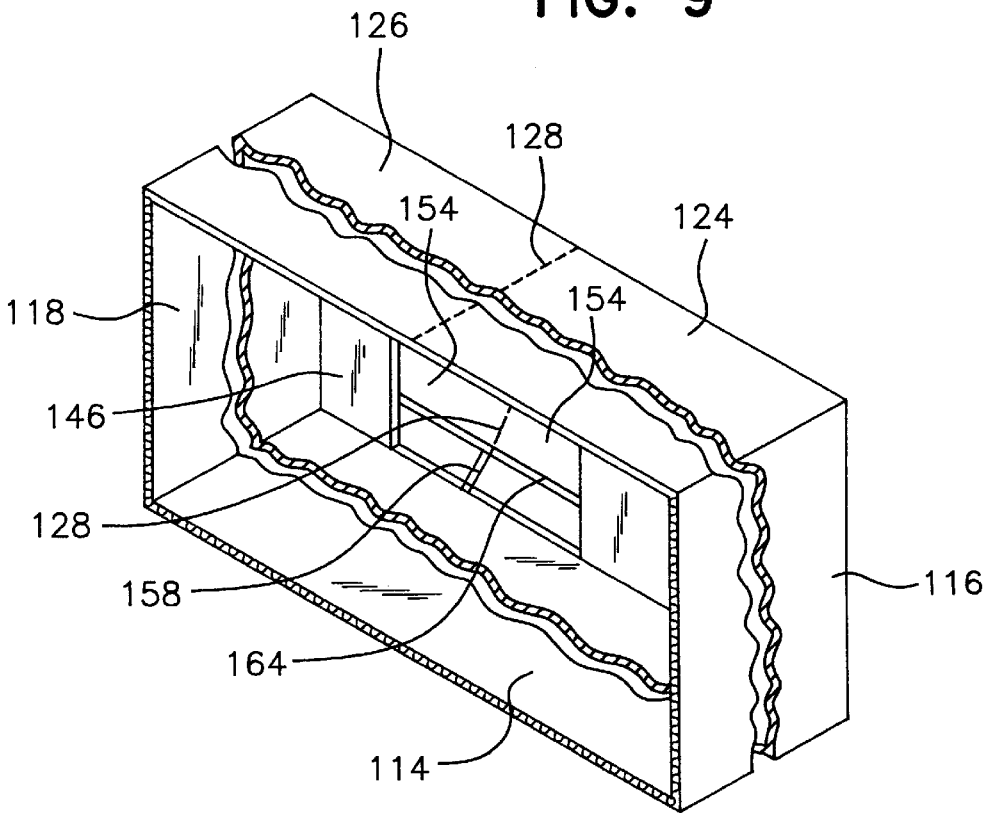
FIG. 9 is a longitudinal sectional view of the inside of the box of FIG. 6 looking toward the bottom wall.
Figure 10:
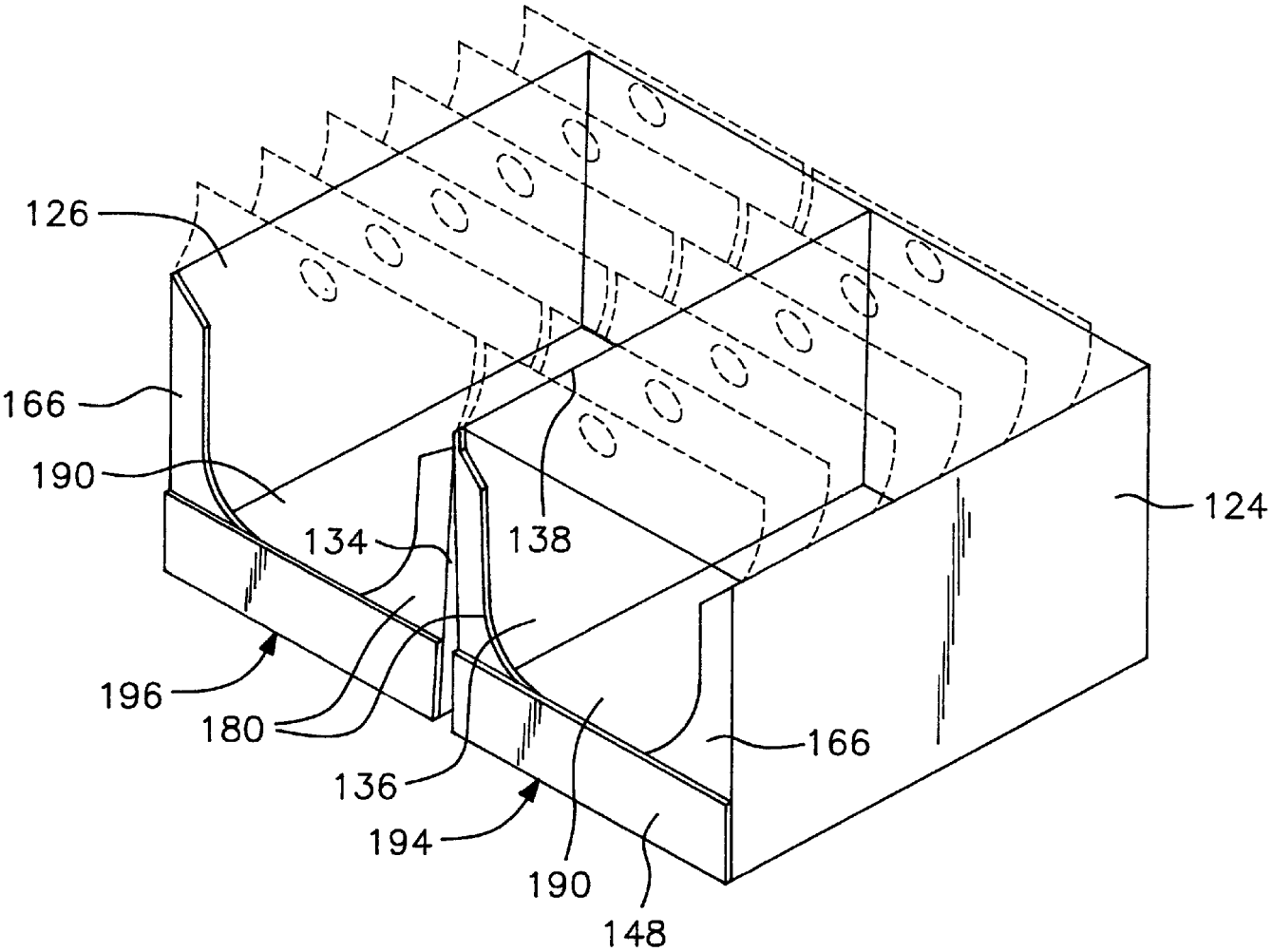
FIG. 10 is a front perspective view of the box of FIG. 6 which has been converted to its container display mode, with the pouches or packages shown in phantom lines.

As illustrated in FIG. 11, the rear end flaps 146 on the end side walls 116 and 118 are preferably separated from rear wall flaps 153 and 155 on the top and bottom side walls 112 and 114 by notches 162. In addition, fold lines 150 are preferably spaced inwardly a slight distance from fold lines 160 to enable the end flaps 146 to be oriented inside rear flaps 153 and 155 in the relationship illustrated in FIGS. 8 and 9. As illustrated in FIGS. 7 and 8, the abutting horizontal edges of the rear flaps 153 and 155 are separated from each other as indicated by reference numeral 164. Thus, the outer portions of each of the rear flaps 153 and 155 is secured by adhesive or the like to the outer surface of the rear end flaps 146 in order to form rear wall 122. In this configuration, the rear wall sections 154 of the rear flaps 153 and 155, and rear wall sections 156 of the rear flaps 153 and 156, remain connected together in both modes of the container.

The upper side wall 112 includes a front upper flap 166 connected to the upper side wall segments 124 and 126 by fold line 174. Front upper flap 166 has a centrally disposed removable front upper segment or panel 168 associated therewith. The leading edge of removable panel 168 preferably projects beyond the outer edge of the flap 166 as illustrated in FIG. 11, with the projecting portion being designated by reference numeral 170. A die cut line or line of severance 172 extends longitudinally inwardly toward fold line 174 and then curves inwardly toward the center and tapers in an inclined manner at 176 to join with a small portion coinciding with the fold line 174 as indicated at 178. The lower side wall 114 includes a front lower flap 180 connected to the lower side wall segments 134 and 136 along a fold line 182. The front lower flap 180 is also preferably provided with a removable segment or panel 184 similar in shape and configuration to the removable segment 168, except that the outer edge of the removable panel 184 preferably coincides with the outer edge of the front lower flap 180. The front lower flap 180 is provided with a cut line or line of severance 186 to form and remove the removable lower panel 184 in a manner similar to the cut line 172 in the front upper flap 166 for removal of the removable upper panel 168. The front lower flap 180 also has a cutout or notch 187 below the cut line 186, between the removable lower panel 184 and fold line 182. The notch or opening 187 allows an operator to insert a thumb or finger into the box 110 to facilitate removal of the removable panels 168 and 184.

The end flaps 148 on end side panels 116 and 118 are preferably separated from the end flaps 166 and 180 by notches 188. Further, fold lines 152 are preferably oriented a slight distance outwardly of the fold lines 174 and 182 so that the flaps 148 can preferable be oriented outwardly of the front upper and lower flaps 166 and 180, as illustrated in FIG. 6. To form the front wall 120, the inside of front upper flap 166 is adhered to the outside of front lower flap 180 by any suitable adhesive, bonding or the like. The inner surface of the flaps 148 is then adhered to the side edges of the front flaps 166 and 180, also by appropriate adhesive, bonding or the like. Further, the inner edges of the flaps 148 are preferably aligned with the outermost edges of the die cut lines 172 and 186, as illustrated in FIG. 6.

The just described structure for the front wall 120, provides not only a rigid front or top wall for the container 110 but also assists in guiding the removal of the front removable upper and lower panels 168 and 184. By engaging the bottom edge of the removable lower panel 184 through the opening or notch 187 and pulling upwardly, the removable lower panel 184 and the attached removable upper panel 168 can be removed from the front wall 120 of the container along die cut lines 186 and 172. The inner edges of the flaps 148 which preferably align with the outermost edges of the die cut lines 172 and 186, facilitate the separation of the panels 168 and 184 as they are pulled upwardly away from flaps 168 and 180.

It will be observed that the tear tape 133 adhered to the inside of front upper flap 166 and removable upper panel 168 is sandwiched between the front upper flap 166 and front lower flap 188, as well as between the removable upper panel 168 and removable lower panel 184. Thus, the continued upward pull of the removable panels 168 and 184 after separation from front flaps 166 and 180 causes the tear tape 133 to remove tear strip 129 along perforations 128 across the center of upper side panel 112, thus dividing the upper side panel 112 into its separate wall segments 124 and 126. Continuing the pull of the tear tape 133 down the rear upper flap 153 divides the flap into its separate rear wall sections 154 and 156. The rear lower flap 155 can then be divided into its separate rear wall sections 154 and 156 along separation line 158, and box 110 has now been divided into two separate display compartments connected by fold line 138. The two compartments are then rotated 90° about fold line 138 so that lower side wall segments 134 and 136 abut each other in the display mode illustrated in FIG. 10.

The removal of the front panels 168 and 184 provides an open front to the box when being converted so that each of the two display container sections has an open area 190 in the front end. The open areas 190 expose a major portion of the packages or pouches 192 positioned in each of the two container sections which are designated by reference numerals 194 and 196 in FIG. 10. As described above, the two container sections 194 and 196 are connected together along fold line 138 between bottom panel segments 134 and 136 which are now back-to-back in the display mode. Further, flaps 148 are positioned along the bottom front of the box when the box is converted to the display mode. Accordingly, it may be desirable to print appropriate commercial indicia or other sales/promotional information on the outside surface of flaps 148 at the time the blank is prepared. Similar information could also be applied to segments 124 and 126 of upper side wall 112 since these segments become the side walls of the display container when placed on the retail shelf or the like.

The corrugations in the blank of the present invention preferably extend from one end edge to the other, i.e. horizontally across when looking at FIG. 12. As such, the corrugations in the upper and lower side walls 112 and 114 extend from fold line 130 toward fold line 132 and between fold line 140 and fold line 142, rather than across the blank as is typical. Thus, the tear lines 128 have the corrugations intersecting in a perpendicular relation to assist in a clean separation of the tear strip 129 and help rigidify the upper and lower side walls 112 and 1124. The end side walls 116 and 118 have the corrugations extending vertically when the container 110 is positioned horizontally, as shown in FIG. 6, to provide vertical strength to the box. The corrugations in the end flaps 146 and 148 are also oriented in the vertical direction and thus provide for maximum rigidity when they are attached to the upper and lower flaps for forming the front and rear walls 120 and 122. The vertical corrugations in the end side walls 116 and 118 and the end flaps 146 and 148 provide for a high level of vertical strength at each of the corners of the box 110 when properly positioned for shipping or storage in the horizonal position shown in FIGS. 6–9.

Hence, a rigid container is provided in which the upper and lower surfaces have maximum length and width dimensions so that the containers can be stacked in a stable condition, as compared to containers stacked on a narrow dimension, while at the same time having the required strength to withstand crushing. The corrugations extending to the removable strip 129 will provide maximum support for this area and still enable the tear strip to be functional to remove a narrow section of the top panel between the panel segments 124 and 126 and between the rear end flaps 154 and 156, thus enabling the box as illustrated in FIG. 6 in the shipping mode to be quickly and easily converted to the container illustrated in FIG. 10 in its display mode.

In manufacture and use, the side walls 112, 114, 116 and 118 of the box 110 are formed from the blank shown in FIG. 11 by folding the adjacent side walls 90° with respect to each other along fold lines 130, 132 and 142. Fastening flap 144 is also folded 90° and secured to the inside of end side wall 116 along the outer edge thereof. The bottom or rear wall 122 is then formed by folding end flaps 146 inwardly along fold lines 150, folding upper end flap 153 and lower end flap thereover along fold lines 160 and securing the upper and lower end flaps 153 and 155 along their inside surfaces to the outer surfaces of end flaps 146. The box 110 is now formed with assembled side walls 112, 114, 116 and 118 and bottom wall 122, and is now ready to receive the pouches or packages 192 through the open top or front wall 120. It will be observed that generally flat flexible pouches or packages 192 can be inserted into the box 110 by standard equipment inasmuch as the pouches or packages can be inserted through the open top in a position generally parallel with the bottom wall 122. As previously described, the flexible pouches or packages are received into the shipping box 110 with their thin tops overlapping and their thicker bottoms abutting the inside of the end side walls 116 and 118.

Once the flexible pouches or packages have been inserted through the open top of the box, the top is then closed by folding front lower flap 180 inwardly along fold line 182 and front upper flap 166 thereover along fold line 174. The inside of front upper flap 166 is preferably adhered to the outer surface of front lower flap 180. End flaps 148 are then folded over the assembled front upper and lower flaps 166 and 180 along fold lines 152 and adhered along their inner surfaces to the side edges of front upper and lower flaps 166 and 180. With the top or front wall 120 so assembled, the shipping box 110 with the flexible packages or pouches 192 aligned therein is now ready for shipping and storage. Inasmuch as the upper and lower side walls 112 and 114 represent the larger side dimension among the walls of the box 110, the box 110 is constructed so that it can be shipped with the side walls 112 and 114 in the horizontal position, as illustrated in FIGS. 6 and 7.

Once the shipping box 110 has reached the retail or other location for display of the flexible pouches or packages, the removable panels 184 and 168 are separated from the front wall 120 by lifting upwardly along the cut line edge 186 through notch 187. Once the removable panels have been lifted upwardly and moved from the front wall 120, the tear tape 133 is used to remove tear strip 129 along perforations 128 across the upper side wall 112 and back down the rear upper flap 153 to divide the upper side wall 112 into its two components 124 and 126 and the rear upper flap 153 into its two components 154 and 156. The rear lower flap 155 is separated along separation line 158 and the box 110 is then in a condition to fold lower side wall 114 along the central fold line 138 so that the segments 134 and 136 abut each other and the box 110 assumes the display condition illustrated in FIG. 10.

Figure 13:
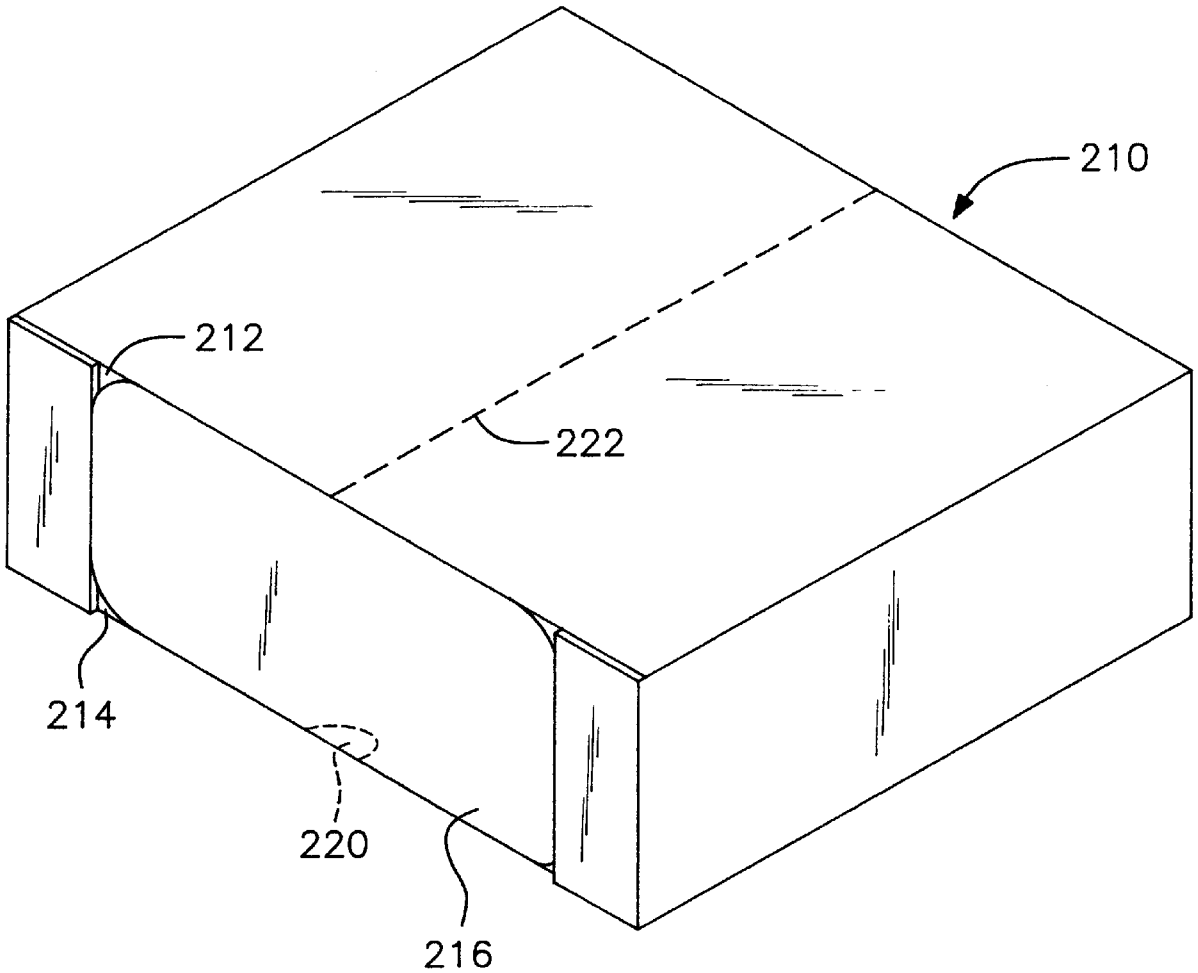
FIG. 13 is a front perspective view of another embodiment of the box or container of the present invention in its shipping mode.
Figure 14:
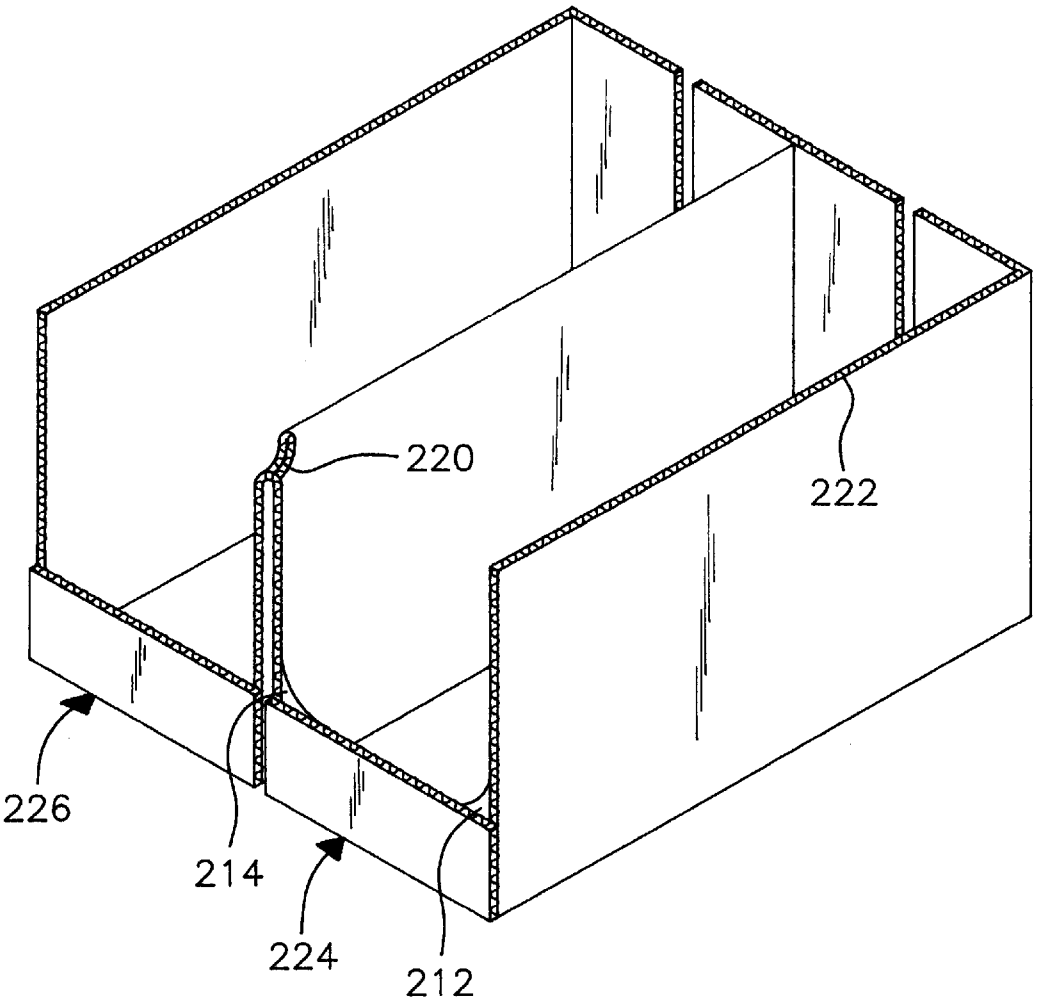
FIG. 14 is a front perspective view of the box or container of FIG. 13 in its display mode.
Figure 15:
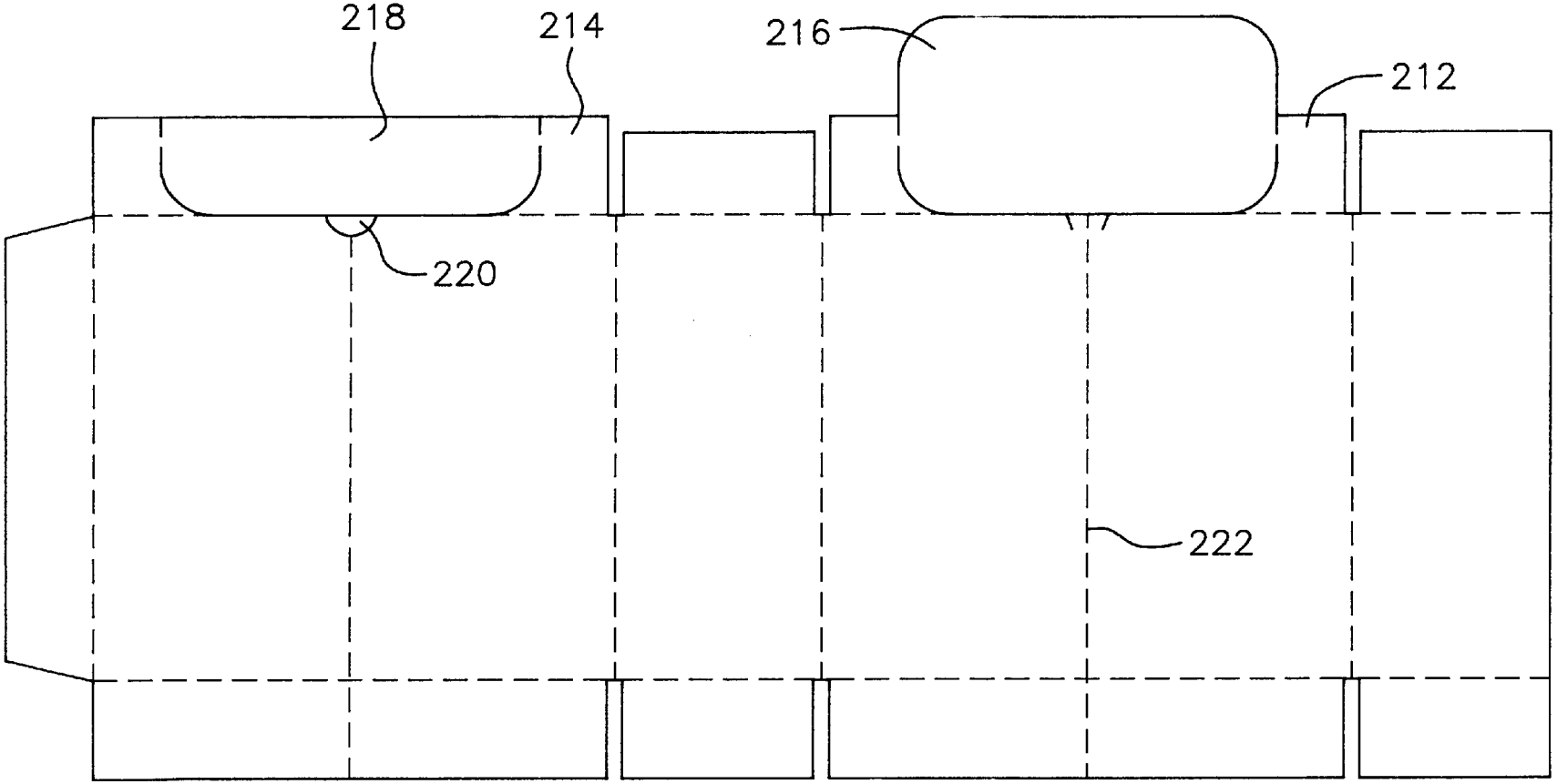
FIG. 15 is a plan view of the blank from which the container of FIGS. 13 and 14 is formed.

FIGS. 13–15 illustrate another embodiment of the box/container of the present invention generally designated by reference numeral 210. Container 210 is substantially the same as that illustrated in FIGS. 6–12 except for the construction of the front flaps 212 and 214. Both of these front flaps include removable segments or panels 216 and 218, respectively, in which the removable upper panel 216 is substantially twice the height of the removable lower panel 218 (which is attached to the lower side wall of the container). In this embodiment, the removable upper panel 216 substantially covers the entire removable lower panel 218 and is suitably secured thereto by adhesive or the like. The removable lower panel 218 is also provided with a semicircular cut out or notch 220 which extends into the center edge of the lower side wall. This notch or opening 220 facilitates the removal of the removable lower panel 218 and the removable upper panel 216 which is secured thereto. The removable panels 218 and 216 then are pulled to separate the tear line area 222 to separate the upper side wall into its two segments, thus enabling the box 210 illustrated in FIG. 13 to be converted to a display container with side-by-side container sections 224 and 226 as illustrated in FIG. 14. The blank illustrated in FIG. 15 from which the box/container 210 of FIGS. 13 and 14 is constructed is similar to the blank illustrated in FIG. 11, except for the structure of the front flaps 212 and 214 and removable front panels 216 and 218, as described above.

With this construction, the end edges of the removable front panels 216 and 218 generally coincide with the edges of the front end flaps on the end side walls so that only a very small portion of the inwardly curved section of the front upper flap 212 and the front bottom flap 214 are observed when the container has been converted to the display mode as illustrated in FIG. 14.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A shipping and display container comprising an upper side wall, a lower side wall in spaced generally parallel relation to the upper side wall, a pair of spaced generally parallel end side walls interconnecting the upper and lower side walls, a rear wall and a front wall oriented in generally perpendicular relation to the side walls, said front wall including a removable front panel, said upper side wall and said rear wall including a tear means, said tear means in said upper side wall having a width substantially less than one-half the width of each of said upper and rear walls to separate the upper side wall and the rear wall into two components, a separation of the upper side wall and the rear wall into two components to enable segments of the lower side wall and segments of the rear wall on opposite sides of the center line to be positioned in adjacent relation to provide a pair of upwardly opening container sections, each of said container sections having a portion of the front wall open upon removal of said front panel, each of said upwardly opening container sections having an outer wall formed by the two components of said upper side wall, each of said outer walls having a height substantially greater than the height of said front wall upon removal of the removable front panel when forming said pair of upwardly opening container sections, each said side wall having an inwardly extending front wall segment.

2. The container as defined in claim 1 wherein said removable front panel in said front wall is defined by a lower flap on a front edge of the lower side wall and an upper flap on a front edge of the upper side wall, said flaps each including a die cut removable portion enabling the flaps to be separated upon removal of the removable portions for forming the opening in the front wall of the container that is substantially symmetrical along a center line of the upper side wall and front wall.

3. A shipping and display container comprising an upper side wall, a lower side wall in spaced generally parallel relation to the upper side wall, a pair of spaced generally parallel end side walls interconnecting the upper and lower side walls, a rear wall and a front wall oriented in generally perpendicular relation to the side walls, said front wall including a removable front panel, said upper side wall and said rear wall being separable along a center line to enable the portions of the upper side wall outwardly of the center line to form outer walls of a pair of upwardly opening container sections with segments of the rear wall outwardly of the center line forming rear walls for said upwardly opening container sections and to enable portions of said lower side wall outwardly of a center line to form inner walls for said pair of upwardly opening container sections, said end side walls forming a bottom for said pair of upwardly opening container sections with removal of said front panel leaving a portion of a front wall of each upwardly opening container section open, said removable front panel in said front wall being defined by a lower flap on a front edge of the lower side wall and an upper flap on a front edge of the upper side wall, said flaps each including a die cut removable portion enabling the flaps to be separated upon removal of the removable portions for forming the opening in the front wall of the container sections that is substantially symmetrical along a center line of the upper side wall and front wall, said die cut removable portions of the front wall flaps including end edges spaced inwardly from end edges of said front wall flaps, said front wall including a pair of end flaps overlying end edge portions on each side of the front flaps on the upper and lower flaps and being adhesively secured thereto for rigidifying said front wall.

4. The container as defined in claim 3 wherein said tear means includes a tear strip extending from the removable front panel in the front wall, along the approximate center line of the upper side wall from a front edge to a rear edge and downwardly along at least a portion of the rear wall to separate the container into two substantially equal container sections.

5. The container as defined in claim 3 wherein all of said walls are constructed of double faced corrugated cardboard, and when the container is positioned horizontally on its lower side wall the corrugations in the upper and lower side walls extend horizontally between the end side walls, the corrugations in the end side walls extend vertically between the upper and lower side walls, the corrugation in the end flaps extending vertically when the end flaps are folded to form a part of the front and rear walls, said tear means intersecting the corrugations in the upper side wall and rear wall with the corrugations in perpendicular relation to the tear means for strengthening the upper side wall adjacent the tear means.

6. The container as defined in claim 3 wherein said tear means includes a continuous tear tape secured to the undersurface of the front wall upper flap, the upper side wall, and a portion of the rear wall to divide the container into two independent segments when the tear tape is pulled outwardly along with the removable front portions, said removable front portion on the upper flap being secured to the removable front portion on the lower flap to remove both removable front portions together when the container is converted from a shipping container to a display container.

7. The container as defined in claim 3 wherein an inner edge of said end flaps is in substantial alignment with an end edge of the removable portions of the front wall flaps to facilitate effective separation along the die cut lines when removing the removable portions of the front wall flaps.

8. The container as defined in claim 3 wherein said removable portion of the front wall upper flap only overlies a part of the removable portion of the front wall lower flap.

9. The container as defined in claim 3 wherein said removable portion of the front wall upper flap completely overlies the removable portion of the front wall lower flap.

10. The container as defined in claim 3 wherein said container includes an opening adjacent a lower edge of the removable front portion of said lower flap to facilitate the separation of the removable portions from the front wall flaps.

11. In combination, a container convertible from a shipping container to a display container and two rows of generally flexible standup tapered packages having a thin top, said container being parallelepiped in configuration and including a first side wall with a narrow longitudinal tear line extending substantially from a front edge to a rear wall and a second substantially parallel side wall said first and second side walls interconnected by a pair of substantially parallel end side walls, said container holding said two rows of said flexible packages with said thin tops in a overlapping relation and said packages generally parallel to said rear wall for shipping, said rear wall and said first side wall being separable along said tear line to form two receptacles for display of said flexible packages in a standup condition in each of the receptacles.

12. The combination as defined in claim 11, wherein said two receptacles are in a side-by-side abutting relationship.

13. The combination as defined in claim 11, wherein said container further includes a front wall along said front edge and generally parallel to said rear wall, said front wall and said rear wall comprising flaps connected via fold lines to at least said first side wall and said second side wall.

14. The combination as defined in claim 13, wherein said front wall and said rear wall also include top flaps connected via fold lines to top edges of said end side walls which are adhered to at least one of said first and second side wall top flaps.

15. The combination as defined in claim 13, wherein said front wall is defined by a lower flap on a front edge of said second side wall and an upper flap on a front edge of said first side wall, said flaps each including removable front wall portions which form openings at the front of said receptacles to enable better observation of said flexible packages during display.

16. The combination as defined in claim 13, wherein said narrow tear line comprises a narrow tear strip extending from said front wall along an approximate center line of said first side wall to said rear wall and continuing along at least a portion of said rear wall to separate the container into said two receptacles, each of said receptacles having substantially the same size and shape, each of said receptacles having an inner wall and outer wall of substantially the same height and extending over a major portion of the height of said packages to retain the packages in standup displayed condition.

17. The combination as defined in claim 16, wherein said tear line also includes a continuous tear tape secured to said front wall, an under surface of said first side wall and an under surface of a portion of said rear wall to assist in dividing the container into said two receptacles.

18. A shipping and display container comprising an upper side wall, a lower side wall in spaced generally parallel relation to the upper side wall, a pair of spaced generally parallel end side walls interconnecting the upper and lower side walls, a rear wall and a front wall oriented in generally perpendicular relation to the side walls, said front wall including a removable front panel, said upper side wall and said rear wall including a tear segment to separate the upper side wall and the rear wall into two components, separation of the upper side wall and the rear wall into two components enabling the lower side wall to pivot along a center line with segments of the rear wall on opposite sides of the center line capable of coming into abutting engagement to provide a pair of upwardly opening container sections having inner and outer walls of substantially the same height, each of said container sections having a portion of the front wall open upon removal of said front panel, said front wall being defined by a lower flap on a front edge of the lower side wall and an upper flap on a front edge of the upper side wall which overlies and is adhered to at least a portion of said lower flap, at least one of said flaps including a die cut removable portion connected to said tear segment, and removal of said front panel facilitating separation of the upper side wall and the rear wall into two components.

19. A shipping and display container comprising an upper side wall, a lower side wall in spaced generally parallel relation to the upper side wall, a pair of spaced generally parallel end side walls interconnecting the upper and lower side walls, a rear wall and a front wall oriented in generally perpendicular relation to the side walls, said front wall including upper and lower flaps and a removable front panel, said upper side wall and said rear wall including a tear segment to separate the upper side wall and the rear wall into two components, separation of the upper side wall and the rear wall into two components enabling segments of the lower side wall on opposite sides of a center line and segments of the rear wall on opposite sides of the center line capable of coming into abutting engagement to provide a pair of upwardly opening container sections, each of said container sections having a portion of the front wall open upon removal of said front panel, at least one of said flaps including a die cut removable portion connected to said tear segment, and removal of said removable portion facilitating said separation, said front wall including a pair of end flaps connected to end side walls and adhered to end edge portions on each side of at least one of said front wall flaps for rigidifying said front wall.

20. The container as defined in claim 19, wherein said tear segment includes a continuous tear tape secured to the under surface of the front wall upper flap, the upper side wall, and a portion of the rear wall to divide the container into said two container sections when the tear tape is pulled outwardly along with the removable portion of the front wall.

21. The container as defined in claim 19, wherein said front wall upper flap and said front wall lower flap both have removable portions adhered together to remove both removable portions together when the container is converted from a shipping container to a display container.

22. The container as defined in claim 19, wherein an inner edge of said end flaps is in substantial alignment with an outer edge of the removable portion of at least one of said front wall flaps to facilitate effective separation along the die cut lines when removing said removable portion.

23. The container as defined in claim 19, wherein said lower side wall includes a fold line at said center line of said lower side wall.

24. The container as defined in claim 19, wherein said lower side wall includes a line along a center line to delineate inner wall on said lower side wall when separating the upper side wall and the rear side wall and form two separated upwardly opening container sections.

25. The container as defined in claim 19, wherein at least one of said upper and lower flaps includes a die cut removable front portion enabling said flap to be separated from said container for dividing said front wall when separating said container into said two container sections.

26. A generally rectangular shipping container for conversion to a pair of display container sections comprising first and second side walls in spaced generally parallel relation and third and fourth side walls in spaced generally parallel relation interconnecting said first and second side walls along four generally parallel side edges, said first and second side walls being substantially larger than said third and fourth side walls, and a bottom wall having at least one flap connected to one of said side walls, a narrow central tear means in said first side wall dividing said first side wall into two substantially equal sections and extending in a line parallel to said side edges to said bottom wall, said second side wall having a dividing means which extends parallel to said side edges and divides said second side wall into two substantially equal sections, said sections of said first side wall and said second side wall being substantially equal, separation of said first side wall and said bottom wall along said tear means dividing said container into two generally equal display container sections, each of said container sections being upwardly open and having inner and outer walls of substantially the same height and said third and fourth side walls forming a bottom for said display container sections in a display condition.

27. The container as defined in claim 26, wherein said top opening is closed by a front wall defined by a lower flap connected via a fold line to a front edge of said first side wall and an upper flap connected via a fold line to a front edge of said second side wall which overlies at least a portion of said lower flap said lower flap and said upper flap adhered to each other to form said front wall.

28. A shipping and display container comprising an upper side wall, a lower side wall in spaced generally parallel relation to the upper side wall, a pair of spaced generally parallel end side walls interconnecting the upper and lower side walls, a rear wall and a front wall oriented in generally perpendicular relation to the side walls, said front wall including a removable front portion, said upper side wall and said rear wall including a tear away element to separate the upper side wall and the rear wall into two components, separation of the upper side wall and the rear wall into two components enables the lower side wall to a configured divide along a center line with segments of the rear wall on opposite sides of the center line capable of coming into generally parallel relation to provide a pair of upwardly opening container sections, each of said container sections have a substantial portion of the front wall open upon removal of said front portion, said removable front portions extending continuously from adjacent the top edge to adjacent the bottom edge of the front wall, said removable front portion having end edges spaced inwardly from the side edges of the front wall.

29. In combination, a container convertible from a shipping container to a display container and two rows of generally flexible standup tapered packages having a thin top, said container being parallelepiped in configuration and including a first side wall with a tear line extending substantially from a front edge to a rear wall and a second substantially parallel side wall with a longitudinal line substantially in the center thereof, said first and second side walls interconnected by a pair of substantially parallel end side walls, said container holding said two rows of said flexible packages with said thin tops in an overlapping relation and said packages generally parallel to said rear wall for shipping, said rear wall and said first side wall being separable about said tear line in the first side wall to form two receptacles with portions of the second side wall on opposite sides of said longitudinal line in said second side wall forming adjacent walls of said receptacles for display of said flexible packages in a standup condition in each of the receptacles, said container further including a front wall along said front edge and generally parallel to said rear wall, said front wall and said rear wall connected via fold lines to said first side wall and said second side wall, said front wall including a removable panel having side edges spaced inwardly from the side edges of the front wall to form a continuous retaining flange across the bottom portion of said packages when in a standup condition and displaying a major portion of the packages.

* * * * *